US006973857B1

(12) United States Patent
Anderson

(10) Patent No.: US 6,973,857 B1
(45) Date of Patent: Dec. 13, 2005

(54) HAND TOOL ADJUSTER

(76) Inventor: Dwain Anderson, PO Box 118, Chevery, QBC (CA) G0G 1G0

( * ) Notice: Subject to any disclaimer, the term of this patent is extended or adjusted under 35 U.S.C. 154(b) by 0 days.

(21) Appl. No.: 10/913,346

(22) Filed: Aug. 9, 2004

(51) Int. Cl.[7] ..... B25B 13/12; B25B 23/145
(52) U.S. Cl. ..... 81/129; 60/591
(58) Field of Search ..... 81/129, 176.1, 81/176.3, 179, 125.1, 185.2, 488, 491, DIG. 6; 60/591

(56) References Cited

U.S. PATENT DOCUMENTS 2,517,941 A * 8/1950 Stubbs ..... 81/129
2,674,096 A * 4/1954 Marshall ..... 60/591
2,835,271 A * 5/1958 Oberthur ..... 137/505.13
3,104,570 A * 9/1963 Haenni et al. ..... 81/126
3,204,497 A * 9/1965 Dinkler ..... 81/77
3,282,136 A * 11/1966 Maichen ..... 81/77
4,031,619 A 6/1977 Gregory
4,151,763 A 5/1979 Colvin
4,325,275 A 4/1982 Colvin
4,689,957 A 9/1987 Gallentine
4,787,275 A * 11/1988 Colvin ..... 81/77
4,957,021 A 9/1990 Helton
5,279,204 A * 1/1994 Arnold ..... 91/376 R
5,415,064 A 5/1995 Chang
5,606,896 A * 3/1997 Shammout ..... 81/77
5,685,206 A 11/1997 Ma
6,305,249 B1 * 10/2001 Wang ..... 81/63

* cited by examiner

*Primary Examiner*—David B. Thomas
*Assistant Examiner*—Robert Scruggs
(74) *Attorney, Agent, or Firm*—Protections Equinox Int'l Inc.; Franz Bonsang

(57) ABSTRACT

An adjusting device for a tool includes a body with two ends and a fluid filled passageway, which extends between the ends, one end of the body cooperates with a work piece. An actuating member is movably connected to one end of the body, communicates with the fluid in the passageway, and has a surface, which cooperates with the work piece. Another actuating member is movably connected to the other end of the body and communicates with the fluid, and moves the fluid against the first actuating member to extend it. The fluid is locked against the first actuating member so that it retains the work piece in the body end.

20 Claims, 6 Drawing Sheets

HAND TOOL ADJUSTER

FIELD OF THE INVENTION

The present invention concerns an adjusting device, and more particularly to an adjusting device for use in a hand-held tool.

BACKGROUND OF THE INVENTION

Adjustable hand-held tools such as wrenches and the like are well known and widely used, either in the home or in industry. The tools typically have mechanically adjustable components, which are hand-operated until a desired torque is applied to a work piece. Hand held tools require certain structural characteristics to be useful for a variety of common applications. The tools need to be ergonomically shaped and sized to permit access of the tool into restricted spaces such as on machinery. In addition, the tools need to be strong and durable to withstand normal operation conditions. Moreover, the mechanism of adjustment should be easy to operate and be able to maintain a precise adjustment. An example of such a mechanically adjustable tool is U.S. Pat. No. 4,787,275, issued Nov. 29, 1988 to Colvin for "Adjustable Doubled-Ended Box Wrench". Disadvantageously, tools with mechanical adjustable components tend to increase the bulk of the tool, especially adjacent the tool head where accessibility is most desirable. Cavities are often disposed within the tool to house the mechanical components, which compromises the strength of the tool's handle, which is used during leveraging. Furthermore, tools with mechanical components may not allow for precise adjustability or maintenance of the adjustment once set. This is because the mechanical components have to be loose fitting in order to reduce friction and to allow the adjusting mechanism to work quickly and easily.

Thus there is a need for an improved adjustment device for a tool.

SUMMARY OF THE INVENTION

The present invention reduces the difficulties and disadvantages of the aforesaid designs by providing a tool with an adjusting device, which operates using the non-compressible properties of a liquid located in a confined space. A novel configuration of a liquid-filled passageway and a pair of finger operated pistons permits high retaining forces to be quickly established against a work piece. A valve lock is used to trap the liquid against either of the pistons to lock either of the pistons and to maintain the pistons pressed against the work piece with a large force. Also, fine adjustments are also accessible using the finger operated pistons and lock. Advantageously, the adjusting device permits a user to quickly and efficiently achieve and maintain high torque forces against the work piece without having to re-adjust the tool. Moreover, the number of mechanical components is significantly reduced and as such, the bulk of the tool is significantly reduced. In addition, the aforesaid problems of handle strength being compromised is significantly reduced or essentially eliminated because the liquid filled passageway is narrow compared to the size of the tool body. One additional design features angled ends of the tool, which permit the tool to be used in restricted spaces.

In accordance with an aspect of the present invention, there is provided an adjusting device for a tool, the device comprises: a body having first and second end portions, and a fluid filled passageway extending between the end portions, the first end portion being cooperable with a work piece; a first actuating member movably connected to the first end portion of the body, the first actuating member communicating with the fluid in the passageway and having a first actuating surface cooperable with the work piece to be retained; and a second actuating member movably connected to the second end portion of the body and communicating with the fluid, the second actuating member moving the fluid against the first actuating member to extend the first actuating member, the fluid being locked against the first actuating member so as to retain the work piece in the first end portion of the body.

Typically, the second actuating member has a second actuating member surface cooperable with the work piece, the first actuating member moving the fluid against the second actuating member to extend the second actuating member, the fluid being locked against the second actuating member to retain the work piece in the second end portion of the body.

Typically, the body is elongate and has first and second piston chambers located adjacent the respective first and second end portions, the chambers being in fluid communication with the passageway.

Typically, first and second piston members are sealingly and movably mounted in the respective first and second piston chambers, the piston members being movable with respect to their respective piston chambers.

Typically, each piston member has a cylindrical piston body sized to be snuggly mounted in the piston chamber; and a seal located around the piston body, the seal being in sealing contact with a sidewall of the piston chamber to permit fluid tight movement of the piston body between an extended position and a retracted position.

Typically, a valve chamber is located between the first and second piston chambers, the passageway extending between the piston chambers and through the valve chamber.

Typically, the body includes a central body portion and a valve chamber, the passageway extending between the piston chambers and through the central body portion.

Typically, the passageway is narrower than the first and second piston chambers.

Typically, a locking member is mounted in a central body portion, the locking member being actuatable to trap the fluid against either the first or the second actuating members.

Typically, the locking member resiliently biases the fluid towards either of the first or second actuating members.

Typically, the locking member includes a valve located in a valve chamber, the valve chamber being located in the central body portion, the passageway extending between the first and second end portions and through the valve chamber, the valve chamber having first and second oppositely disposed valve seats.

Typically, the valve has first and second valve balls of sufficient size to block movement of the fluid on either side of the valve chamber, the valve balls being seated in the respective ball seats to block movement of the fluid; and first and second resilient springs connected to each of the respective valve balls, the valve balls being resiliently biased into the respective ball seats to block movement of the fluid in the passageway.

Typically, the valve balls are urgeable away from their respective valve seats to permit fluid to move in the passageway.

Typically, a finger operated actuator is mounted in a body sidewall and in communication with the valve to urge the valve balls away from their respective valve seats, the finger operated actuator including a valve needle extending towards between the valve balls and a resilient seal surrounding the valve needle.

Typically, at least one wrench end is connected to either of the first or second end portions of the body, the wrench end being cooperable with the work piece.

Typically, two wrench ends are connected to either of the first or second end portions of the body, the wrench ends being angled with respect to the body.

In one embodiment, the first actuating surface is angled relative to the body so as to be cooperable with the work piece to be retained in the first end portion of the body.

Alternatively, the body further have a central body portion located between the first and second end portions, the two end portions being angled with respect to the central body portion.

Typically, the fluid is a liquid; preferably a hydraulic liquid.

Typically, the tool is a box end wrench.

In accordance with another aspect of the present invention, there is provided an adjusting device for use with a box end wrench, the device comprises: an elongate body having first and second end portions, first and second piston chambers located adjacent the end portions, and a hydraulic liquid filled passageway extending between the piston chambers, the end portions each being cooperable with a work piece; a first piston member movably connected to the first piston chamber, the first piston member communicating with the liquid in the passageway and having an actuating surface cooperable with the work piece to be retained; a second piston member movably connected to the second piston chamber and communicating with the liquid for moving the liquid against the first piston member; and a valve disposed in the passageway and located between the first and second end portions of the body, the valve being actuatable to trap the liquid against either the first or the second piston members, the liquid being trapped against the first piston member so as to retain the work piece in the first end portion.

In accordance with a further aspect of the present invention, there is provided a box end wrench, the wrench comprises: a wrench body having first and second wrench ends for cooperating with a work piece, and first and second piston chambers located adjacent the wrench ends; first and second pistons movably mounted in the respective piston chambers for retaining the work piece in the wrench ends; a hydraulic liquid filled passageway extending between the piston chambers, the liquid being in communication with each of the pistons, so that when one piston is depressed, the liquid moves towards the other piston to extend it against the work piece; and a valve disposed in the passageway between the wrench ends, the valve being actuatable to trap the liquid against the extended piston so as to retain the work piece in the wrench end.

BRIEF DESCRIPTION OF THE DRAWINGS

Further aspects and advantages of the present invention will become better understood with reference to the description in association with the following Figures, in which.

DETAILED DESCRIPTION OF THE PREFERRED EMBODIMENTS

Figure 1:
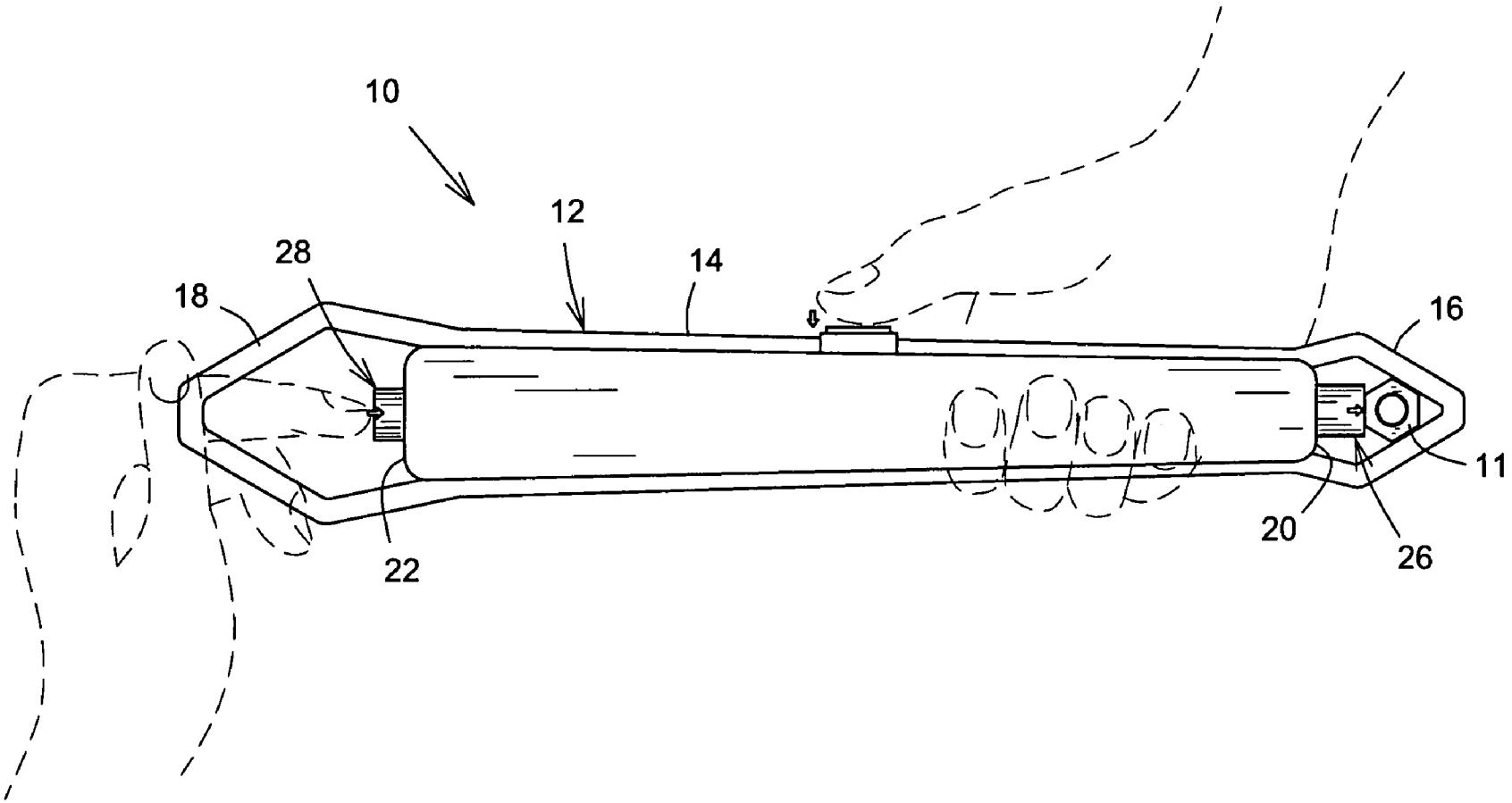
FIG. 1 is a simplified top view of a box end wrench in accordance with an embodiment of the present invention.
Figure 2:
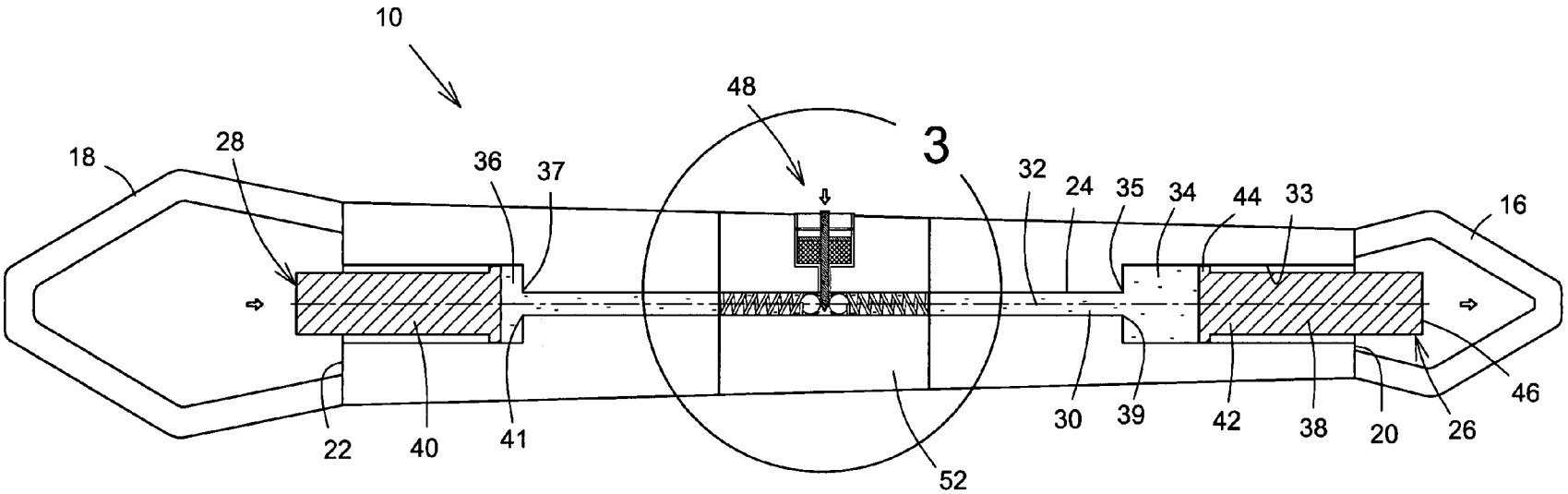
FIG. 2 is a simplified longitudinal section of the wrench showing an adjusting device with a valve chamber of the embodiment of FIG. 1.

Referring now to FIGS. 1 and 2, an embodiment of an adjusting device of the present invention is shown generally at 10 in use with a hand held tool 12 such as a box end wrench. The tool 12 includes an elongate body 14 with two wrench ends 16, 18 connected to respective body end portions 20, 22. The adjusting device 10 is used to lockingly retain a work piece 11, such as a bolt, nut and the like, in either of the wrench ends 16, 18 once a desired level of retaining tightness is achieved. Although two wrench ends 16, 18 are illustrated throughout, it is to be understood that a single wrench end may be connected to one of the body end portions without deviating from the scope of the invention.

Figure 2A:
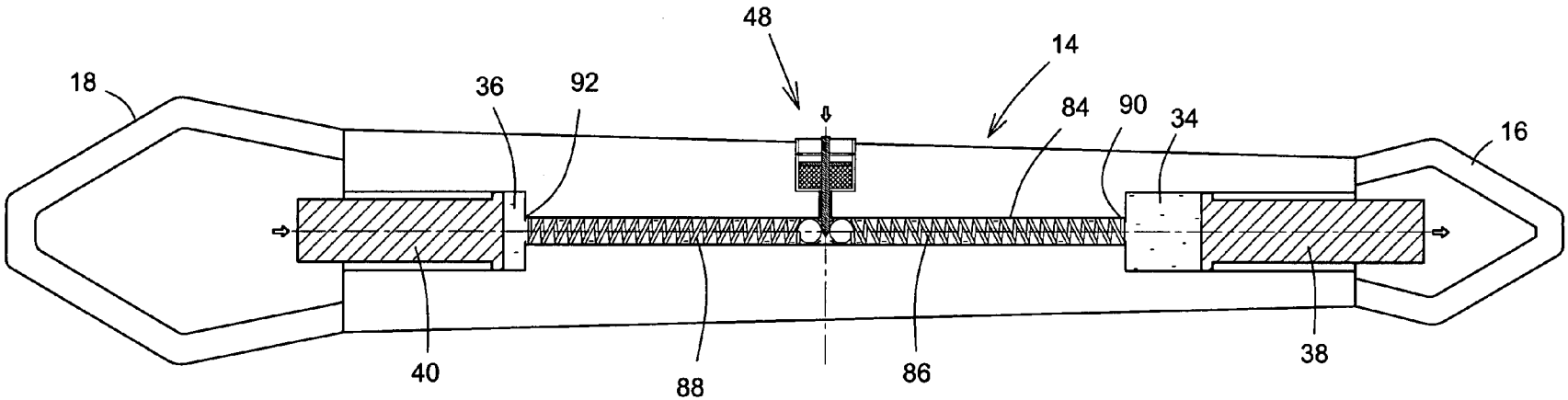
FIG. 2*a* is a simplified longitudinal section of a single piece box end wrench showing another embodiment of an adjusting device.

The wrench ends 16, 18 are typically hexagonally shaped and of different sizes to cooperate with work pieces of different sizes. One skilled in the art will recognize that the wrench ends 16, 18 may also be any shape, which is dictated by the shape and/or type of work piece 11 to be retained. Moreover, the wrench ends 16, 18 may be different shapes on the same tool 12. The tool body 14 and the wrench ends 16, 18 are typically made of stainless steel and may be made of separate sections, as best illustrated in FIG. 2, which may be disassembled for maintenance or may be of a one piece design, as illustrated in FIG. 2*a*.

Broadly speaking, the adjusting device 10 includes a passageway 24, which extends between the two body end portions 20, 22, a first actuating member 26 and a second actuating member 28. The first actuating member 26 is movably connected to the first end portion 20 of the body, and the second actuating member 28 is movably connected to the second end portion 22 of the body. A fluid 30 is disposed in the passageway 24 and substantially fills the passageway 24. The fluid 30 extends between the two actuating members 26, 28 and is in communication with them. The passageway 24 is configured so that when an operator depresses the second actuating member 28, using a thumb or a finger of a hand (shown in phantom lines in FIG. 1), the actuating member 28 forces the fluid 30 in the passageway 24 to move towards the first actuating member 26. The fluid 30 pushes against the first actuating member 26 and moves it away from the first end portion 20 of the body 14 and towards the work piece 11. The actuating member 26 pushes against the work piece 11 and retains it in the wrench end 16. Similarly, if desired, when the operator depresses the first actuating member 26, the fluid 30 moves in the passageway 24 towards the second actuating member 28 away from the second end portion 22 of the body 14 to retain the work piece 11 or a different work piece, in the second wrench end 18. Because of its non-compressibility under normal operating pressures, a liquid is used as the fluid, and more particularly a hydraulic liquid is used. One skilled in the art will understand that many types of hydraulic fluid are available and may be used in the passageway 24. The passageway 24 includes a longitudinal passageway axis 32. The passageway 24 opens up into first and second piston chambers 34, 36, which are located adjacent the respective first and second end portions 20, 22 of the body 14. The fluid 30 in the passageway 24 extends into the piston chambers 34, 36.

Referring now specifically to FIG. 2, first and second piston members 38, 40 are movably mounted in the respective first and second piston chambers 34, 36 and are movable with respect to their piston chambers 34, 36. As each of the piston members 38, 40 are essentially identical, only the piston member 38 will be described in detail. The piston member 38 includes a piston body 42, which is sized to be snuggly mounted in the piston chamber 34 to permit free and easy movement of the piston body 42 therein. In the embodiment illustrated, the piston body 42 is typically cylindrical, as is the corresponding piston chamber 34, which snuggly receives it. One skilled in the art will, however, recognize that the piston body 42 and the piston chamber 34 may be any shape. A seal 44, typically a cup seal, is located around the piston body 42 and makes a sealing contact with a sidewall 33 of the piston chamber 34. The seal 44 permits fluid tight movement of the piston body 42 between an extended position and a retracted position. The piston body 42 includes an actuating surface 46, which contacts the work piece 11 during its retention, as best illustrated in FIG. 1. The actuating surface 46 may be planar to accommodate hexagonal nut surfaces or, depending upon the shape of the wrench end, may be any shape. Typically, the passageway 24 has a width, which is narrower than the width of the piston chambers 34, 36. The narrow width of the passageway 24 substantially improves the strength of the tool body 14. Accordingly, a pair of throttlings 35, 37 extend between the passageway ends 39, 41 and the piston chambers 34, 36.

Figure 3:
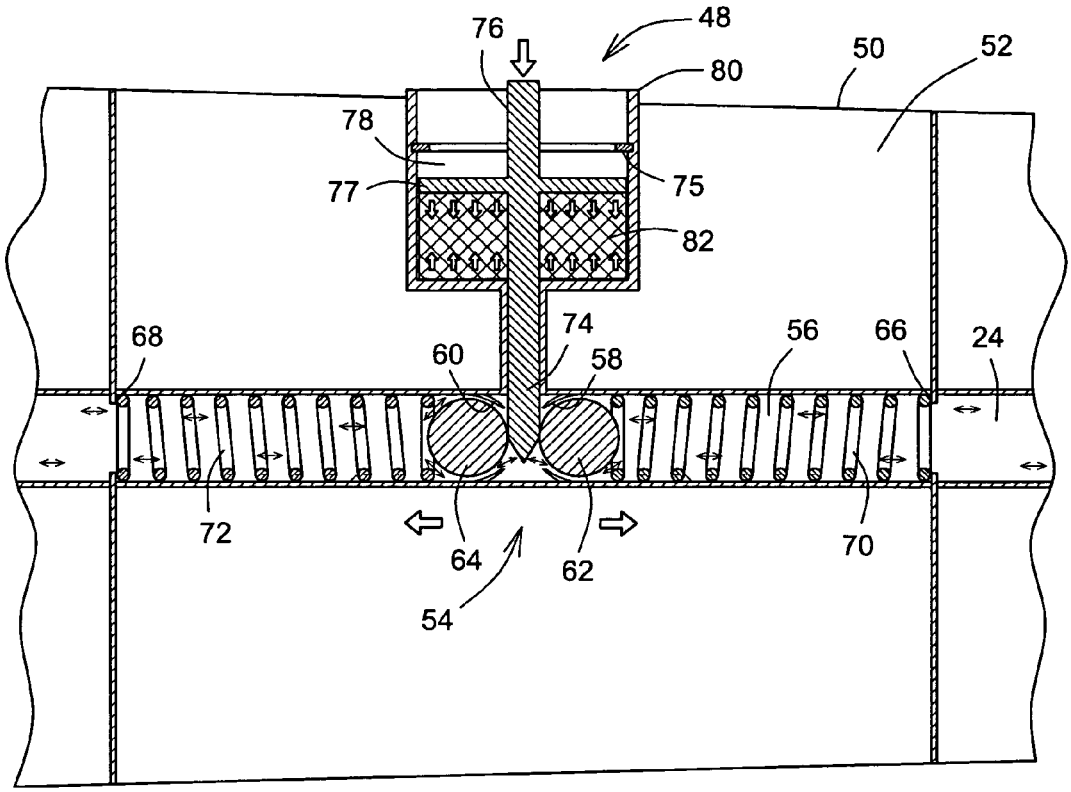
FIG. 3 is an enlarged section view taken along line 3 of FIG. 2, showing the locking member in an adjusting configuration.
Figure 4:
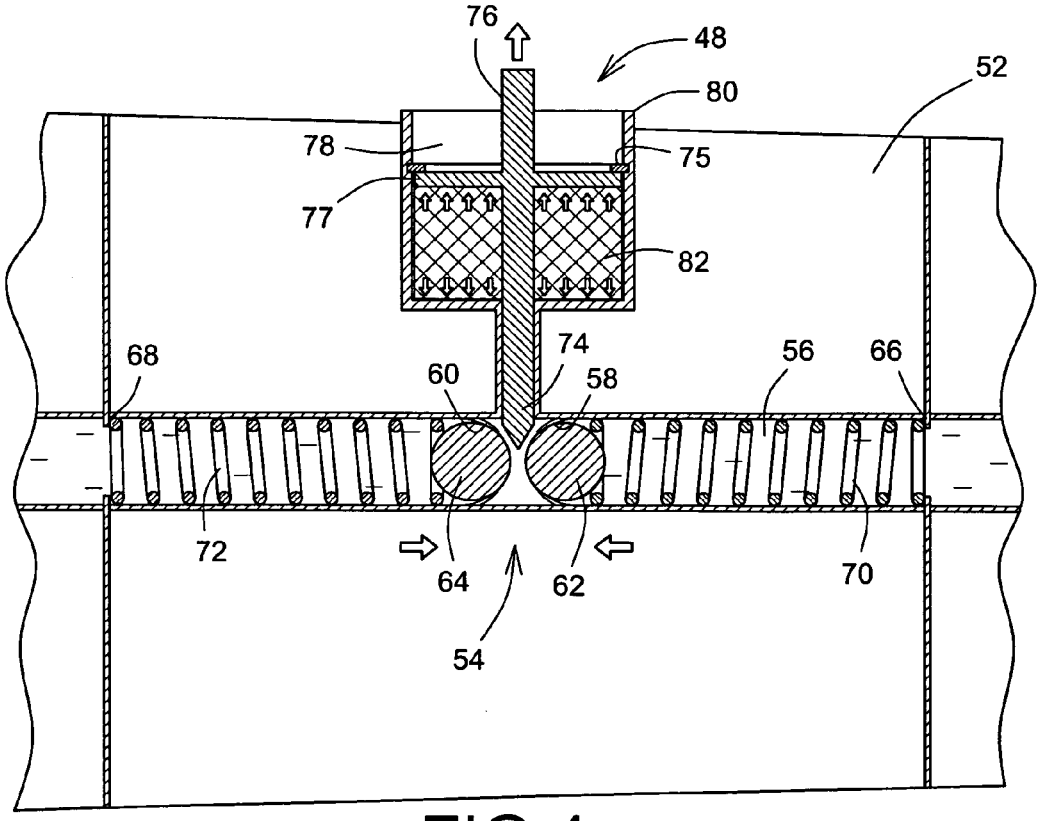
FIG. 4 is an enlarged section view similar to FIG. 3, showing the locking member in a locked configuration.

Referring now to FIGS. 2, 3 and 4, to lock the fluid 30 in the passageway 24 against either of the extended piston members 38, 40, an actuatable locking member 48 is used. The locking member 48 may be mounted in a body sidewall 50 of a central body portion 52 and includes a valve 54, which is actuatable using the thumb or finger of one hand by the operator once the desired level of tightness of the piston members against the work piece 11 is achieved. The valve 54 resiliently biases the fluid 30 towards either of the first or second actuating members 26, 28. The valve 54 is disposed in a valve chamber 56 located in the passageway 24 between the first and second piston chambers 34, 36. The passageway 24 extends between the piston chambers 34, 36 and through the central body portion 52. As best illustrated in FIG. 4, the locking member 48, in the retaining configuration, traps the fluid in the passageway 24 on both sides of the valve 54 so that it cannot drain away from the piston chamber 34 or 36. The fluid 30, when trapped, prevents the piston member 38 or 40 from being moved back into the corresponding piston chamber 34 or 36. As such, the work piece 11 is retained in the wrench end 16 or 18 against the piston member 38 or 40 with a strong force.

The valve chamber 56 includes first and second valve seats 58, 60, which are located opposite each other. The valve 54 has first and second valve balls 62, 64, which are connected to respective valve chamber ends 66, 68 via two resilient tension springs 70, 72. The valve balls 62, 64 each protrude through small holes (not shown) located in the valve chamber 56. The valve balls 62, 64 are each of sufficient size to block movement of the fluid 30 on either side of the valve chamber 56. In a locking configuration, the tension springs 70, 72 resiliently bias the valve balls 62, 64 into their respective valve seats 58, 60 to block movement of the fluid 30 therethrough. In addition, the tension springs 70, 72 counteract the effects of gravity when the tool is tilted. The valve balls 62, 64 are located adjacent each other. The valve 54 includes a valve needle 74, which is connected to a finger-operated actuator 76. The valve needle 74 extends into the valve chamber 56 and, in the locking configuration, rests adjacent the valve balls 62, 64. The finger-operated actuator 76 is a button with a preferably integral flange 77, which is located in a recess 78 in the body sidewall 50. A safety wall 80 surrounds the button and slightly protrudes form the body sidewall 50 to reduce inadvertent activation of the actuator 76. A C-clip 75 is located around the needle 74 and cooperates with a groove around the wall 80 to secure the valve 54 and limit the displacement of the flange 77 of the button 76 and the needle 74 away from the valve balls 62, 64 in the locking configuration. A resilient seal 82 is located between the button flange 77 and the lower portion or bottom wall of the recess 78. The resilient seal 82 surrounds the valve needle 74 and compresses when the button is depressed, and decompresses to force the button back away from the valve balls 62, 64 so that the operator can retrieve the button. In an adjusting configuration, as best illustrated in FIG. 3, the button may be moved so that the valve needle 74 moves between the valve balls 62, 64 to urge against the biasing tension springs 70, 72 to dislodge the valve balls 62, 64 from their valve seats 58, 60. This opens the passageway 24 and permits the fluid 30 to move along the passageway 24 towards either of the piston chambers 34, 36. Although not illustrated, the locking member 48 may also be located a distance away from the passageway 24 so that the safety wall 80 extends further away from the central body portion 52 and only the valve needle 74 passes through the body portion 52. This may further improve the strength of the tool body 14 by decreasing the number of parts therein.

As best illustrated in FIG. 2*a*, the tool body 14 may be constructed from a single piece of material. An elongate valve chamber 84 extends between the piston chambers 34, 36 and includes two elongate resilient tension springs 86, 88, which are connected to the ends of the valve chamber 90, 92. The elongate valve chamber 84 is integral with the passageway 24 and is substantially filled with the liquid 30 as described above.

Operation

Referring now to FIGS. 1, 3 and 4, a typical operation of the adjusting device 10 will now be described in detail.

The operator typically grasps the tool 12 around the body 14 and locates the wrench end 16 around the work piece 11. The wrench end 16 is maneuvered around the work piece 11 until it cooperates with work piece 11 and the work piece 11 lies adjacent the actuating surface 46 of the piston member 38. Using the thumb or finger of one hand, the user presses the actuatable button 76, which forces the valve needle 74 between the valve balls 62, 64. The force compresses the resilient seal 82 against the bottom of the recess 78 and overcomes the resiliently biasing force of the two tension springs 70, 72. The valve balls 62, 64 are dislodged from their respective valve seats 58, 60. The liquid 30 in the passageway 24 is now free to move therein. With the thumb or finger of the other hand, the operator depresses the second piston member 40 moving it towards the second end portion 22 of the body 14, which moves the liquid 30 along the passageway 24, through the valve chamber 56 towards and against the first piston member 38. The operator continues to depress the second piston member 40 until the required retaining force of the first piston member 38 is applied to the work piece 11. The operator then releases the actuatable button 76 so that the valve needle 74 moves away from the two valve balls 62, 64. The resilient seal 82 expands to its original state and the two tension springs 70, 72 bias the valve balls 62, 64 back into their valve seats 58, 60. This locks the valve 54 and traps the liquid 30 on both sides of the valve 54. Importantly, the movement of the liquid 30 on the side of the valve adjacent the first piston chamber 34 is restricted and maintains the first piston member 38 in an extended position against the work piece 11. The non-compressibility of the liquid 30 column in the passageway 24 maintains the work piece 11 in a strongly retained manner in the wrench end 16, thereafter the wrench 12 may be used in a conventional manner to tighten or loosen the work piece 11. To release the work piece 11, the operation is reversed. To use the second wrench end 18 to retain the work piece 11, the operation is essentially identical to that described above, with the exception that after the actuatable button 76 is depressed, the first piston member 38 is then depressed to force the liquid against the second piston member 40.

Alternatives

The embodiments as illustrated in FIGS. 1, 2, and 2*a* are typically used to retain work pieces located in generally accessible locations. In certain applications, accessibility of these tools may be problematic, such as in areas where accessibly is at ergonomically disfavored angles. To address this, an alternative tool, as illustrated generally at 100 in FIG. 5, may be used. The use of the tool 100 and the adjusting device 10 located therein is generally identical to that described above, except that the tool 100 has certain structural difference which will now be described.

Figure 5:
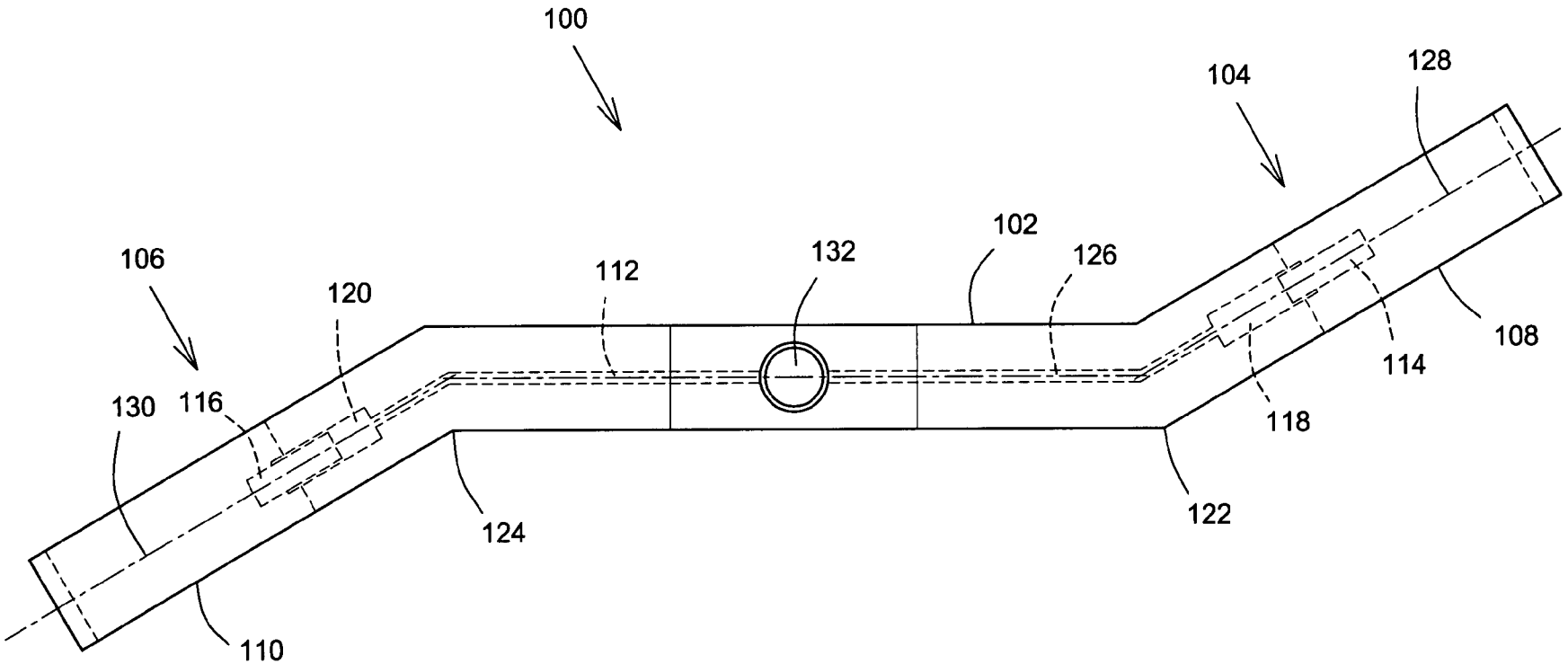
FIG. 5 is a side view of an alternative embodiment of a box end wrench with the adjustment device.

The tool 100, when viewed from a side elevation, as in FIG. 5, includes an elongate body 102 with two end portions 104, 106, which are angled relative to the plane of the body 102. Two wrench ends 108, 110 are located at the two end portions 104, 106. A fluid filled passageway 112 extends between the end portions 104, 106. Like the embodiments illustrated in FIGS. 2 and 2*a*, a pair of pistons 114, 116 are movable mounted in respective piston chambers 118, 120. The passageway 112 extends past a pair of angled joints 122, 124 and enters the piston chambers 118, 120. The passageway 112 has a passageway axis 126 and the piston chambers 118, 120 have respective piston chamber axes 128, 130. The tool 100 also includes an actuatable locking member 132, which is disposed in the passageway 112. In the embodiment illustrated in FIG. 5, the end portions 104, 106 are angled in a staggered manner relative to the body 102, although one skilled in the art will recognize that the end portions 104, 106 may be angled towards each other.

Figure 7:
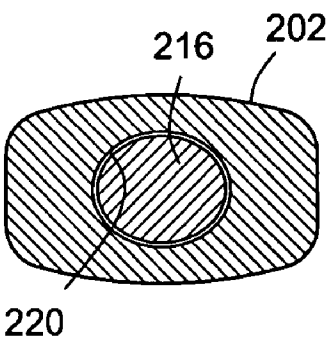
FIG. 7 is a simplified enlarged section view taken along line 7—7 of FIG. 6.
Figure 6:
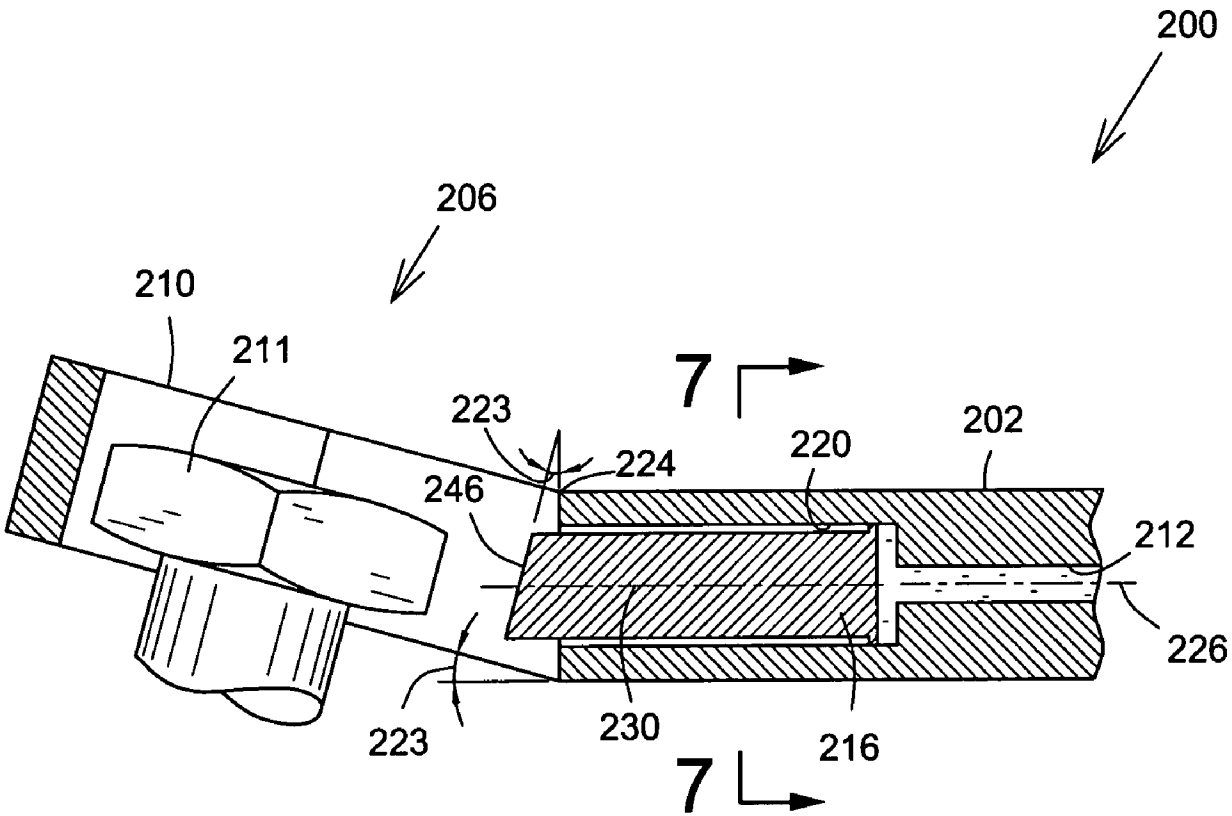
FIG. 6 is a simplified broken section view of another embodiment of a box end wrench with the adjustment device.

Another tool 200, when viewed from a side elevation, as in FIG. 6, is similar to the tool 100 except that the two angled joints 224 are located away from the passageway 212 at the distal end of the respective piston chambers 220, such that only the two wrench ends 210 form the end portions 206 of the body 202. It is noted that for ease of illustration, only one side of the tool 200 is shown, the other side being similar. Since the pistons 216 are part of the central section of the body 202 and are substantially displaced along their axes 230 generally parallel to the passageway axis 226, their actuating surfaces 246 are angled to substantially the same angle 223 of the angle joints 224 to properly and evenly abut and meet the angled surface of the respective work piece 211 positioned in line with the angled end portions 206. Accordingly, the pistons 216 are shaped to prevent their rotation about their axes 230 within their respective piston chambers 220, as shown in FIG. 7. The pistons 216 and their chambers 220 have a generally non-circular cross-sectional shape, typically an elliptical shape. It would be obvious to one skilled in the art that other means to prevent rotation of the pistons 216 could be considered, such as a keyed piston (not shown), without departing from the scope of the present invention.

While specific embodiments have been described, those skilled in the art will recognize many alterations that could be made within the spirit of the invention, which is defined solely according to the following claims.

I claim:

1. An adjusting device for a tool, the device comprising:

a body having first and second end portions, and a fluid filled passageway extending between the end portions, the first end portion being cooperable with a work piece;

a first actuating member movably connected to the first end portion of the body, the first actuating member communicating with the fluid in the passageway and having a first actuating surface cooperable with the work piece to be retained; and a second actuating member movably connected to the second end portion of the body and communicating with the fluid, the second actuating member moving the fluid against the first actuating member to extend the first actuating member, the fluid being locked against the first actuating member so as to retain the work piece in the first end portion of the body.

2. The device, according to claim 1, in which the second actuating member has a second actuating member surface cooperable with the work piece, the first actuating member moving the fluid against the second actuating member to extend the second actuating member, the fluid being locked against the second actuating member to retain the work piece in the second end portion of the body.

3. The device, according to claim 1, in which the body is elongate and has first and second piston chambers located adjacent the respective first and second end portions, the chambers being in fluid communication with the passageway.

4. The device, according to claim 3, in which first and second piston members are sealingly and movably mounted in the respective first and second piston chambers, the piston members being movable with respect to their respective piston chambers.

5. The device, according to claim 4, in which each piston member has:

a cylindrical piston body sized to be snuggly mounted in the piston chamber; and a seal located around the piston body, the seal being in sealing contact with a sidewall of the piston chamber to permit fluid tight movement of the piston body between an extended position and a retracted position.

6. The device, according to claim 3, in which a valve chamber is located between the first and second piston chambers, the passageway extending between the piston chambers and through the valve chamber.

7. The device, according to claim 3, in which the body includes a central body portion and a valve chamber, the passageway extending between the piston chambers and through the central body portion.

8. The device, according to claim 3, in which the passageway is narrower than the first and second piston chambers.

9. The device, according to claim 1, in which a locking member is mounted in a central body portion, the locking member being actuatable to trap the fluid against either the first or the second actuating members.

10. The device, according to claim 9, in which the locking member resiliently biases the fluid towards either of the first or second actuating members.

11. The device, according to claim 10, in which the locking member includes a valve located in a valve chamber, the valve chamber being located in the central body portion, the passageway extending between the first and second end portions and through the valve chamber, the valve chamber having first and second oppositely disposed valve seats.

12. The device, according to claim 11, in which the valve has:

first and second valve balls of sufficient size to block movement of the fluid on either side of the valve chamber, the valve balls being seated in the respective ball seats to block movement of the fluid; and first and second resilient springs connected to each of the respective valve balls, the valve balls being resiliently biased into the respective ball seats to block movement of the fluid in the passageway.

13. The device, according to claim 12, in which the valve balls are urgeable away from their respective valve seats to permit fluid to move in the passageway.

14. The device, according to claim 13, in which a finger operated actuator is mounted in a body sidewall and in communication with the valve to urge the valve balls away from their respective valve seats, the finger operated actuator including a valve needle extending towards between the valve balls and a resilient seal surrounding the valve needle.

15. The device, according to claim 1, in which at least one wrench end is connected to either of the first or second end portions of the body, the wrench end being cooperable with the work piece.

16. The device, according to claim 1, in which the fluid is a liquid.

17. The device, according to claim 1, in which the fluid is a hydraulic liquid.

18. The device, according to claim 1, in which the tool is a box end wrench.

19. An adjusting device for use with a box end wrench, the device comprising:

an elongate body having first and second end portions, first and second piston chambers located adjacent the end portions, and a hydraulic liquid filled passageway extending between the piston chambers, the end portions each being cooperable with a work piece;

a first piston member movably connected to the first piston chamber, the first piston member communicating with the liquid in the passageway and having an actuating surface cooperable with the work piece to be retained;

a second piston member movably connected to the second piston chamber and communicating with the liquid for moving the liquid against the first piston member; and a valve disposed in the passageway and located between the first and second end portions of the body, the valve being actuatable to trap the liquid against either the first or the second piston members, the liquid being trapped against the first piston member so as to retain the work piece in the first end portion.

20. A box end wrench, the wrench comprising:

a wrench body having first and second wrench ends for cooperating with a work piece, and first and second piston chambers located adjacent the wrench ends;

first and second pistons movably mounted in the respective piston chambers for retaining the work piece in the wrench ends;

a hydraulic liquid filled passageway extending between the piston chambers, the liquid being in communication with each of the pistons, so that when one piston is depressed, the liquid moves towards the other piston to extend it against the work piece; and a valve disposed in the passageway between the wrench ends, the valve being actuatable to trap the liquid against the extended piston so as to retain the work piece in the wrench end.

* * * * *